United States Patent [19]

Langenfeld et al.

[11] Patent Number: 4,606,692

[45] Date of Patent: Aug. 19, 1986

[54] QUICK-MOUNT LOADER FOR ARTICULATED TRACTORS

[75] Inventors: Joseph W. Langenfeld; Neal W. Westendorf, both of Onawa, Iowa

[73] Assignee: Westendorf Mfg. Co., Inc., Onawa, Iowa

[21] Appl. No.: 525,135

[22] Filed: Aug. 22, 1983

[51] Int. Cl.[4] ..... B66C 23/00

[52] U.S. Cl. ..... 414/686; 172/275

[58] Field of Search ..... 414/686; 172/272–275

[56] References Cited

U.S. PATENT DOCUMENTS

| | | | |
|---|---|---|---|
| 2,959,233 | 11/1960 | Scarlett et al. | 172/274 |
| 3,805,980 | 4/1974 | Kisaka | 414/686 |
| 3,982,643 | 9/1976 | MacGregor et al. | 172/273 X |
| 3,991,890 | 11/1976 | Frank | 414/686 |

FOREIGN PATENT DOCUMENTS

| | | | |
|---|---|---|---|
| 118318 | 8/1969 | Norway | 414/686 |

*Primary Examiner*—Robert J. Spar
*Assistant Examiner*—Dennis Williamson
*Attorney, Agent, or Firm*—Zarley, McKee, Thomte, Voorhees & Sease

[57] ABSTRACT

A materials handling apparatus for a tractor comprising a U-shaped frame which is quickly mounted and dismounted. The frame comprises a front frame portion having a pair of side frame portions extending upwardly and rearwardly from the lower opposite sides thereof. Boom arms are pivotally secured to the upper rearward ends of the side frame portions and are raised and lowered relative thereto by hydraulic cylinders which are positioned forwardly of the front wheels of the tractor. Releasable connectors are provided between the U-shaped frame and the tractor to enable the apparatus to be quickly and easily mounted and dismounted.

1 Claim, 10 Drawing Figures

QUICK-MOUNT LOADER FOR ARTICULATED TRACTORS

BACKGROUND OF THE INVENTION

Many types of tractor loaders have been previously provided which may be easily mounted and dismounted on tractors. The conventional tractor loaders normally comprise a U-shaped frame means which is adapted to be removably mounted on a supporting frame on the tractor. The U-shaped frame means normally has a pair of rear towers extending upwardly therefrom to which is mounted boom arms.

The advent of large four-wheel articulated tractors presents a problem in that the conventional tractor loaders cannot be mounted thereon due to the large front wheels of the tractor. A further problem is the fact that the tractors are normally articulated to provide front and rear articulated sections.

Further, conventional tractor loaders often have high lift capacity when the bucket is near the ground but do not have nearly as high a capacity when the bucket is near its full height position due to the position of the lift cylinders.

Therefore, it is a principal object of the invention to provide a loader for a four-wheel tractor.

A further object of the invention is to provide a loader for a four-wheel articulated drive tractor.

A further object of the invention is to provide a loader for a tractor including a front frame portion having side frame portions extending upwardly and rearwardly therefrom with the hydraulic cylinders for the boom arms being positioned forwardly of the front wheels of the tractor.

Still another object of the invention is to provide a tractor loader having lift cylinders uniquely positioned so that the loader is able to lift nearly the same weight when the bucket is on the ground as when it is in its full height position.

Yet another object of the invention is to provide a loader for a tractor including means for quickly mounting and dismounting the loader.

SUMMARY OF THE INVENTION

Figure 1:
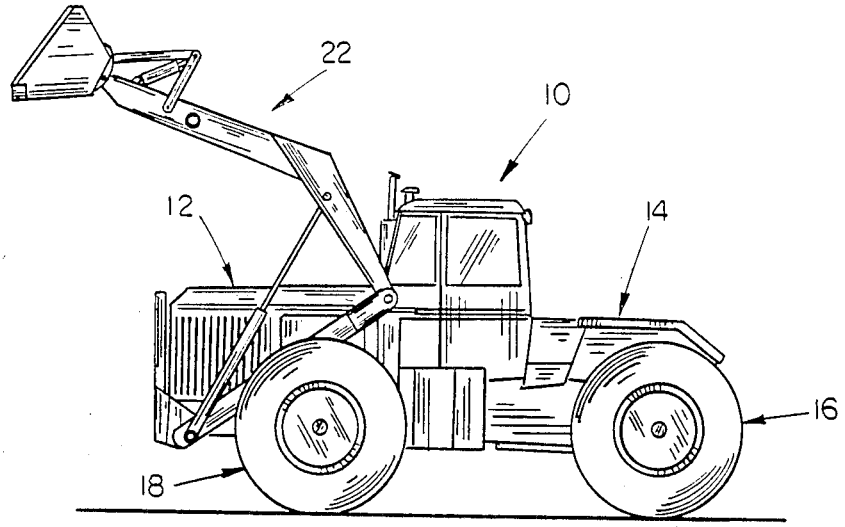
FIG. 1 is a side view of a tractor having the loader mounted thereon.
Figure 2:
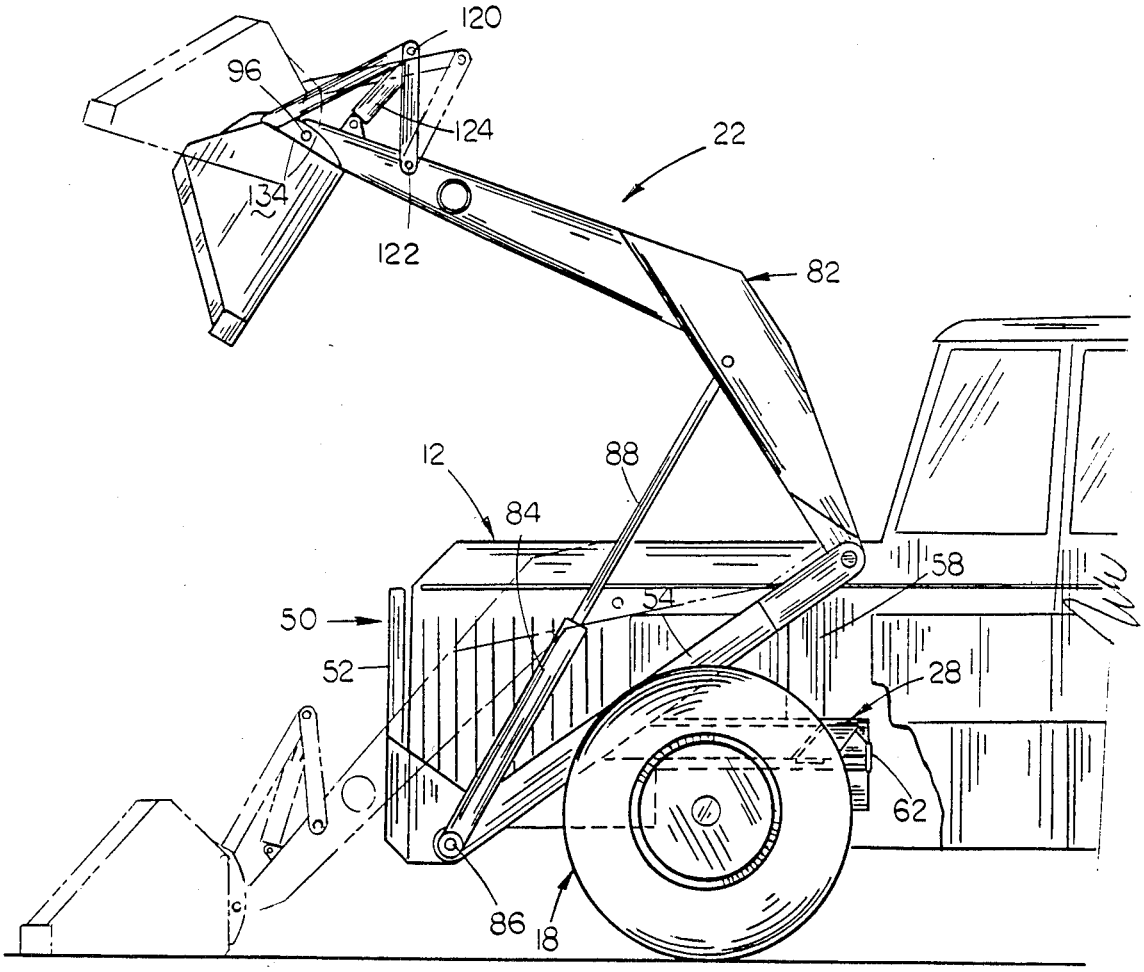
FIG. 2 is a view similar to FIG. 1 illustrating the various positions to which the loader and bucket may be moved.
Figure 4:
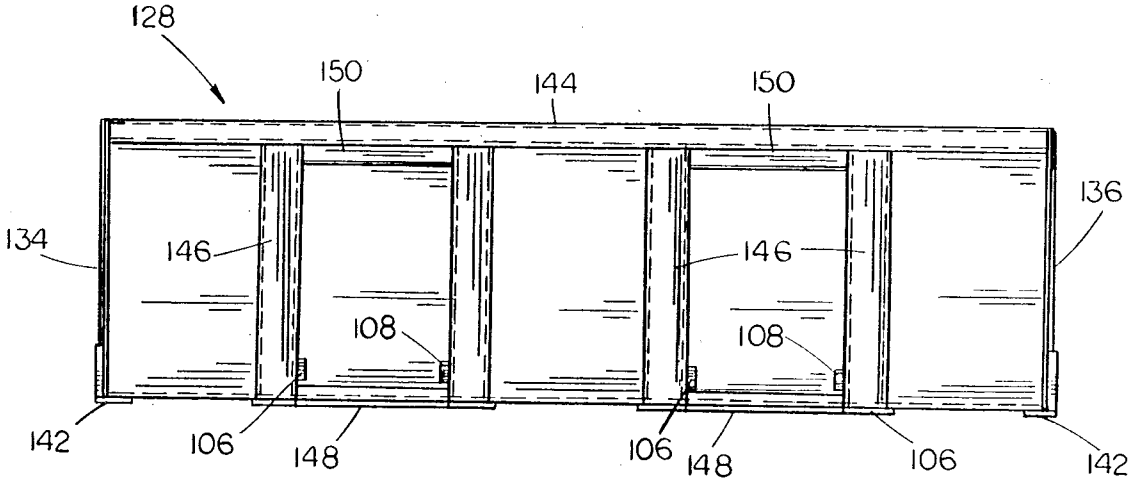
FIG. 4 is a rear elevational view of the loader bucket.
Figure 5:
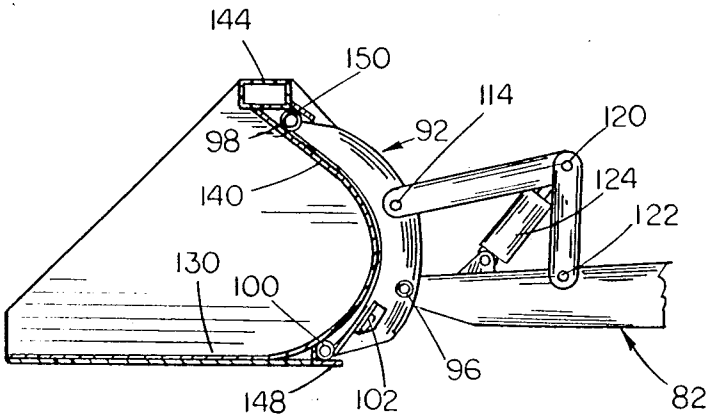
FIG. 5 is a sectional view of the bucket.
Figure 3:
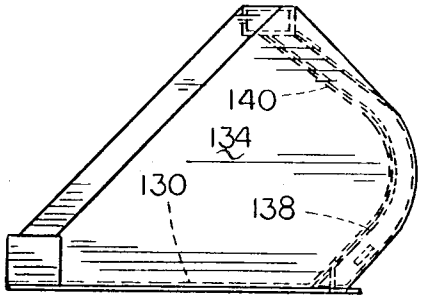
FIG. 3 is an end elevational view of the loader bucket.

The tractor loader of this invention comprises a U-shaped frame means including a front frame having a pair of side frames extending upwardly and rearwardly from the opposite lower sides thereof. A pair of boom arms are secured to the upper ends of the side frames and extend forwardly therefrom. Hydraulic cylinders interconnect the side frames and the boom arms so that the hydraulic cylinders are normally positioned forwardly of the front wheels of the tractor. Releasable connection means is provided to enable the loader to be quickly mounted and dismounted.

DESCRIPTION OF THE PREFERRED EMBODIMENT

The numeral 10 refers to a four-wheel tractor of the articulated type comprising a front articulated section 12 and a rear articulated section 14. Tractor 10 is provided with a pair of rear wheels 16 and a pair of front wheels 18.

Figure 10:
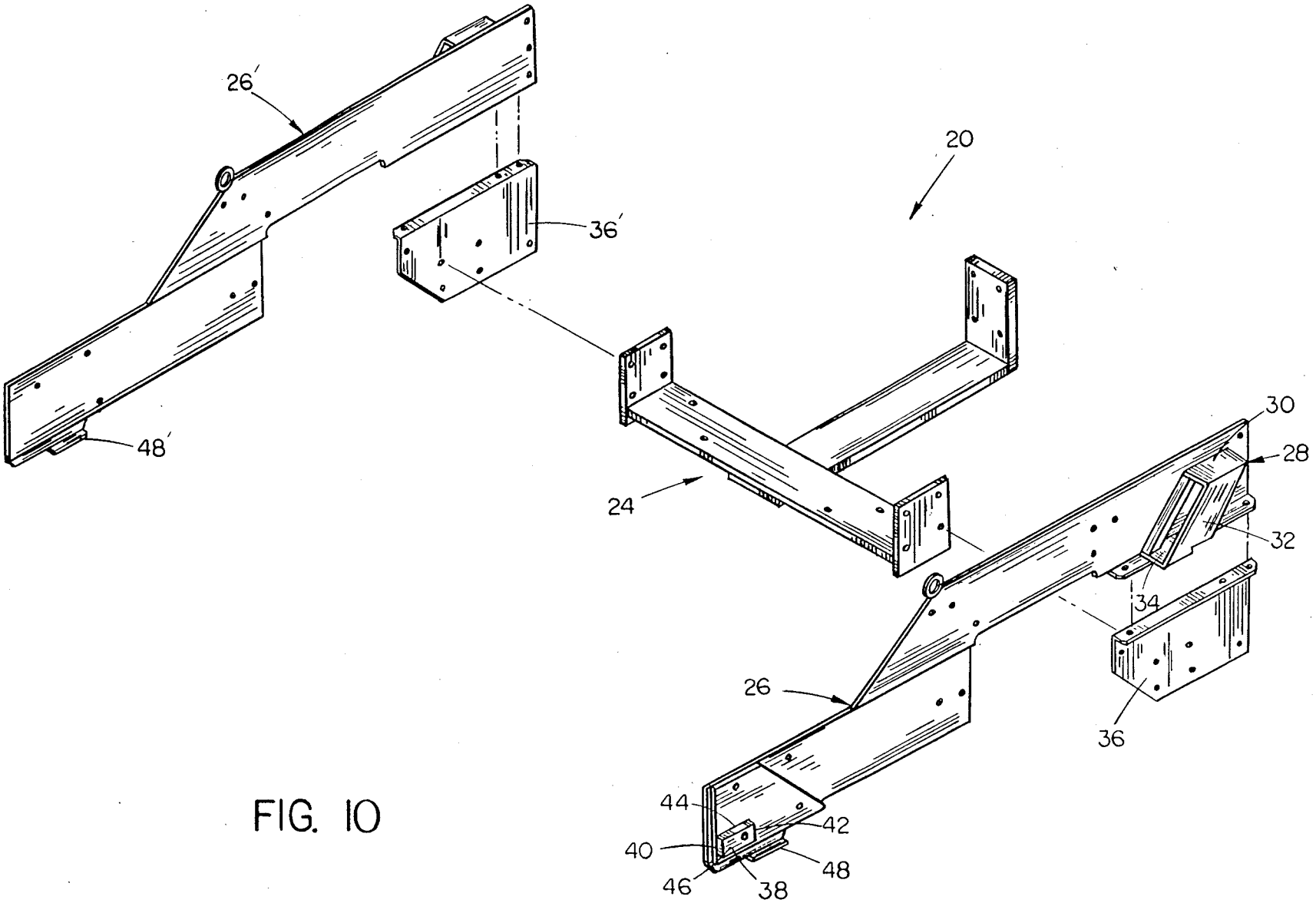
FIG. 10 is a perspective view of the supporting frame for the loader which is mounted on the tractor.

FIG. 10 illustrates a supporting frame and which is refered to by the reference numeral 20. Supporting frame 20 forms a portion of the loader 22 and is designed to support the loader 22 on the tractor.

Supporting frame 20 comprises a center frame portion 24 which is bolted to the underside and sides of the front articulated portion 12. Side supporting frames 26 and 26' are bolted to opposite sides of the tractor and are mirror images of each other. Inasmuch as side supporting frames 26 and 26' are identical, only side supporting frame 26 will be described in detail.

The numeral 28 refers to a connector element or pocket which is secured to the exterior surface of the rearward end of the frame 26. Pocket 28 includes an upper wall 30, outer 32, and lower wall 34. As seen in the drawings, the forward and rearward ends of the pocket 28 are open and that the rearward end of bottom wall 34 is spaced forwardly of the rearward end of top wall 30. Frame 24 is secured to frames 26 and 26' by brackets 36 and 36' respectively.

A rectangular block 38 is secured to the forward end of frame 26 by welding or the like and extends outwardly therefrom as illustrated in FIG. 10. For purposes of description, block 38 will be described as having a forward end 40, rearward end 42, top portion 44 and bottom portion 46. As seen in FIG. 10, bracket 48 extends laterally outwardly from the lower end of frame 26 below block 38.

Figure 9:
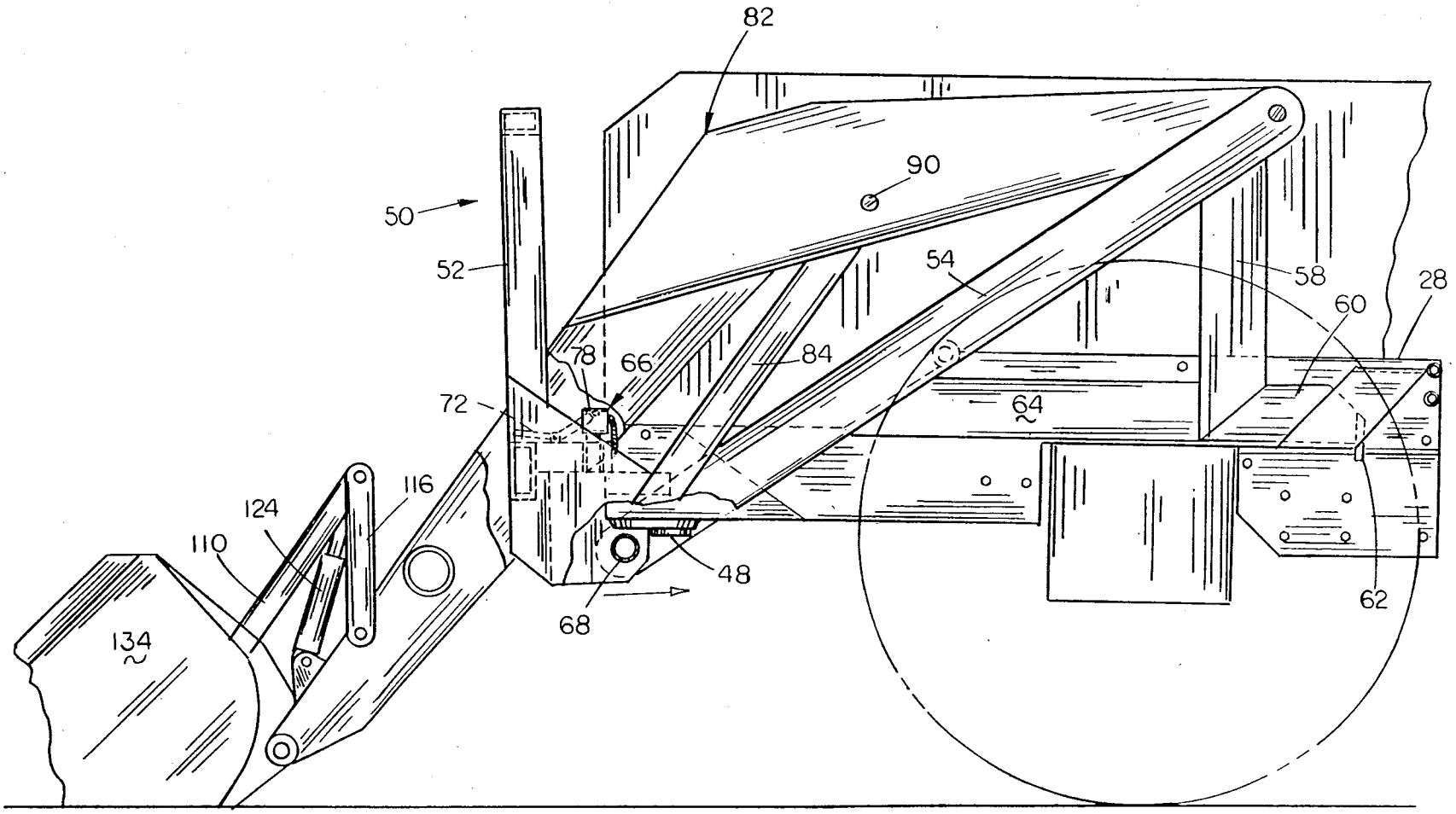
FIG. 9 is a view similar to FIG. 7 except that the loader has been mounted on the tractor.

Loader 22 includes a substantially U-shaped frame means 50 which is adapted to be removably secured to the supporting frame 20 on the tractor 10. Frame means 50 includes a front frame 52 having a pair of side frames 54 and 56 (not shown) extending upwardly and rearwardly from the opposite lower sides thereof. Side frame 56 is identical to side frame 54. Frame member is secured to and extends downwardly from the rearward end of side frame 54 and includes a rearwardly extending portion 60 as best illustrated in FIG. 9. Finger 62 extends downwardly from the lower rearward end of rearwardly extending portion 60. Frame member 64 is secured to and extends between frame members 54 and 58 as seen in FIG. 9 for strengthening purposes.

A pair of locking or connector 66 and 66' (not shown) are secured to the inside surfaces of front frame 52 at opposite sides thereof. Pipe or shaft 86 extends horizontally between the opposite sides of front frame 52 at the lower end thereof and is designed to engage the underside of the brackets 48 and 48' as will be described in more detail hereinafter.

Each of the locking elements 66 comprises a rectangular channel member 70 having a locking lever 72 pivotally mounted thereon at 74. A spring-loaded pin 76 is vertically moveably received in the rearward end of the channel 70 and has a hollow channel member 78 mounted at the upper end thereof. As seen in FIG. 8 of the drawings, the rearward end of lever 72 is received within the forward end of the channel member 78 and is designed to raise the pin or plunger 76 at times so that the lower end thereof does not protude below the lower end of channel 70. A small lip 80 is provided in the upper interior of channel member 78 which is adapted to yieldably engage the rearward end of lever 72 to provide a means for maintaining the pin 76 in the unlocked position of FIG. 7. When the forward end of lever 72 is moved upwardly, the plunger or pin 76 moves downwardly from the lower end of channel member 70.

A pair of boom arms 82 and 82' are pivotally connected at their upper rearward ends to the frame members 54 and 56 respectively. A hydraulic cylinder 84 is secured at its base end to the outer end of pipe 86 and extends upwardly therefrom. Likewise, a cylinder 84' (not shown) extends between frame member 56 and boom arm 82'. The rod 88 of cylinder 84 is connected to the boom arm 82 at 90. Quick-attach assemblies 92 and 92' are pivotally secured to the forward ends of boom arms 82 and 82' respectively. Inasmuch as assemblies 92 and 92' are identical, only assembly 92 will be described in detail.

Assembly 92 comprises an arcuate bracket 94 pivotally connected to the forward end of boom arm 82 by means of pin 96. An enlongated pipe 98 is secured to the upper end of bracket 94 and an elongated pipe 100 is secured to the lower end of bracket 94. Plates 102 and 104 are pivotally connected to opposite sides of bracket 94 for engagement with the lugs 106 and 108 respectively as will be described hereinafter.

Figure 6:
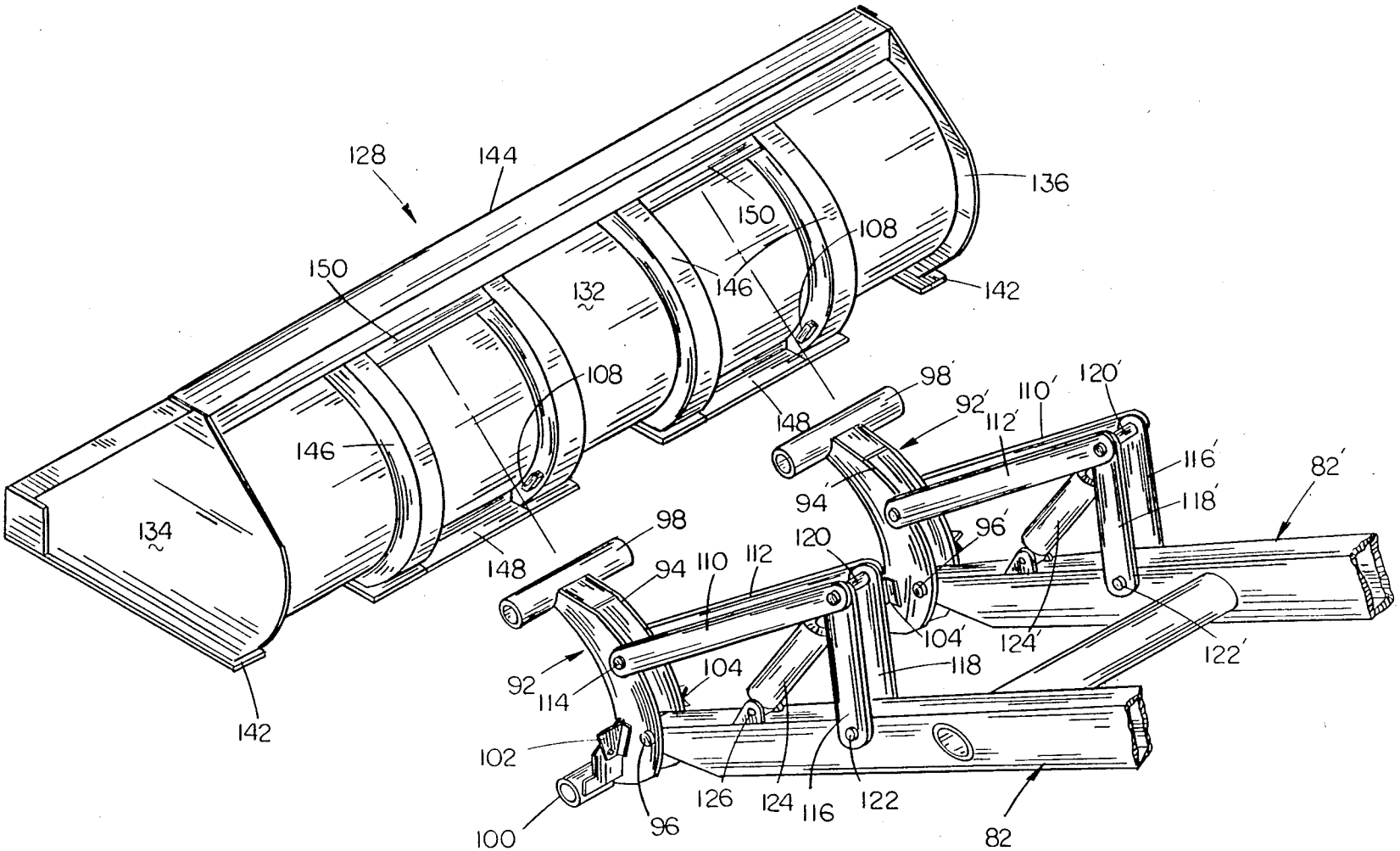
FIG. 6 is a partial rear perspective view of the loader bucket and the quick attach means.

As seen in FIG. 6, a pair of arms or links 110 and 112 are pivotally connected to bracket 94 by pin 114 and extend rearwardly therefrom. Arms or links 116 and 118 are pivotally connected to the rearward ends of arms 110 and 112 by means of pin 120. The lower ends of arms 116 and 118 are pivotally connected to the boom arm 82 by pin 122. Hydraulic cylinder 124 is pivotally connected at its base end to the boom arm 82 by pin 126 and has its rod end connected to the pin 120.

The numeral 128 refers to a materials-handling bucket including a bottom wall 130, back wall 132, and opposite side walls 134 and 136. If desired, bottom wall 130 and back wall 132 may be integrally formed. As seen in the drawings, back wall 132 includes a lower end portion 138 which extends upwardly and rearwardly from the rearward end of bottom wall 130 and an upper end portion 140 which extends upwardly and forwardly from the upper end of lower end portion 138. Rub bars 142 are secured to the underside of bottom wall 130 as seen in FIG. 6. A hollow tube 144 is secured to the upper end of back wall 132 and extends between the side walls 134 and 136. The strength of the bucket is achieved by means of the curved tubular ribs or members 146 which are welded to the rearward side of back wall 132. The upper ends of the tubular members 146 are welded to the underside of tube 144. The lower ends of the tubes 146 are also welded to an angle member 148. As seen in the drawings, the lugs 106 and 108 are secured to the tubes 146 rearwardly of the exterior surface of back wall 132. As best seen in FIG. 6, bars 150 are secured to and extend between adjacent pairs of the tubes 146.

In operation, a supporting frame 20 is installed on a tractor as previously described and remains on the tractor even though the loader is moved therefrom.

Figure 7:
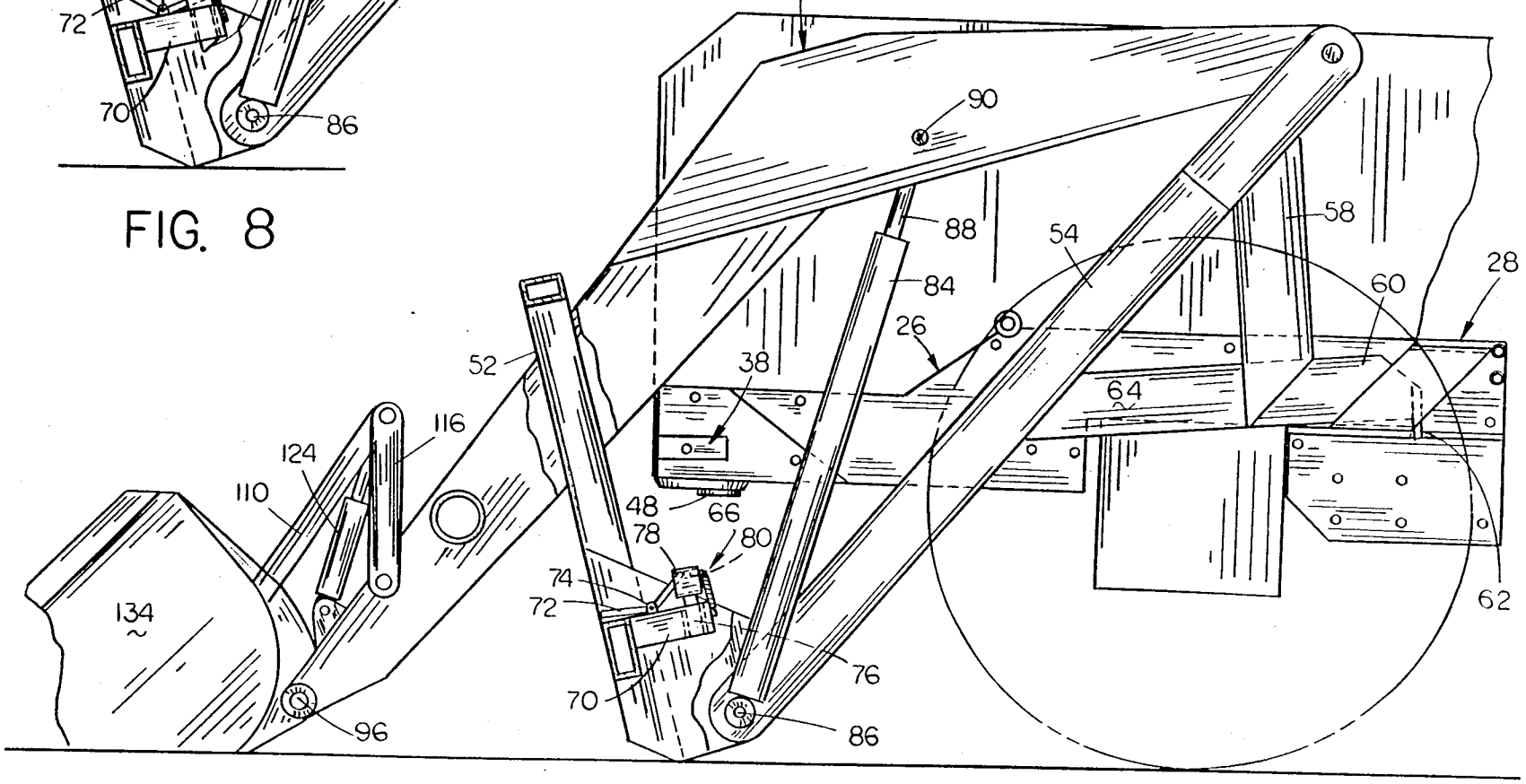
FIG. 7 is a side view illustrating the loader being mounted on the tractor with portions thereof cut away to fully illustrate the invention.
Figure 8:
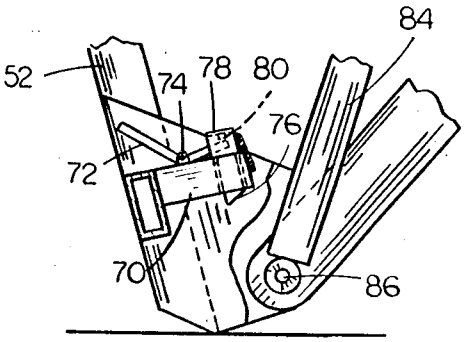
FIG. 8 is a side elevational view illustrating the locking mechanism in its locked position.

Ordinarily, the loader 22 is positioned on the ground as illustrated in FIG. 7. When it is desired to mount the loader on the tractor, the tractor is moved forwardly between the side frames 54 and 56. The hydraulic hoses between the tractor and the loader are then connected. The hydraulic cylinders 84 and 84' are then manipulated to cause the rearward end of the frame means 50 to be properly positioned relative to the pockets 28. When the rearward end of the frame means 50 has been properly positioned so that the fingers 62 may enter the pocket, the tractor is driven forwardly until the fingers 62 can engage the lower rearward end of the pockets 28. The cylinders 84 and 84' are then retracted which causes the frame means 50 to pivot upwardly relative to the tractor about fingers 62. The cylinders 84 are retracted until the lower end of the channel members 70 on each of the connectors 66 and 66' are positioned above the blocks 38. Lever 72 is previously moved to the position illustrated in FIG. 8 so that the plunger 76 is extended. The tractor is then moved forwardly so that the lower ends of the channels slide rearwardly on the blocks 38 until plunger 76 is positioned rearwardly of the block 38. The plunger 76 automatically moves downwardly behind the block 38. Pipe or shaft 86 engages the underside of the members 48 to prevent the loader frame from moving upwardly and downwardly relative to the tractor.

To remove the loader, the lever 72 is moved to the position of FIG. 9. The tractor is then backed out reversing the procedures just described.

Thus it can be seen that a novel loader has been provided which permits a loader to be easily and quickly mounted on a large four-wheel drive tractor. The fact that the frame members 54 and 56 extend upwardly and rearwardly from the front frame 52 enables the proper clearance between the loader and the tractor to be achieved. The arrangement of the cylinders 84 and 84' is also important in that the cylinders are positioned forwardly of the large front wheels of the tractor.

The position of the cylinders 84 and 84' achieve still another objective. The position of the cylinders 84 and 84' provides a loaded power curve which lifts nearly the same weight when the bucket is on the ground as when it is in the full height position.

It is also important to note that the rectangular configuration of the pockets 28 is quite important since it adds stability to the tower or the rearward portion of the loader once it is mounted on the tractor. It should also be noted that the blocks 70 ride on the blocks 38 to keep the subframe from going down while the shaft 86 engages pad 48 to keep the subframe from going higher. The engagement of the blocks 70 with the blocks 38 and the pipe or shaft 86 with the members 48 provides the necessary stability for the forward portion of the loader.

Thus it can be seen that the apparatus of this invention accomplishes at least all of its stated objectives.

I claim:

1.

A materials handling apparatus for a tractor having a rearward end, forward end, opposite sides, a pair of front wheels and a pair of rear wheels, comprising, first and second support frames secured to opposite sides of the tractor and having rearward and forward ends, each of said first and second support frames having a front connector element and a rear connector element, a generally U-shaped frame means adapted to be detachably secured to and supported on the connector elements on said support frames, said U-shaped frame means comprising a front frame portion having upper and lower ends and opposite sides, said front frame portion being positioned forwardly of the forward end of the tractor when said U-shaped frame means is mounted on said support frames, first and second elongated frame members secured to opposite sides of said front frame portion adjacent the lower end thereof and extending upwardly and rearwardly therefrom over the axles of the front wheels of the tractor when said U-shaped frame means is mounted on said support frames, third and fourth frame members extending rearwardly from said first and second frame members respectively, first and second boom arms pivotally secured at one end thereof to the rearward ends of said first and second frame members and extending forwardly therefrom, a first hydraulic cylinder pivotally secured at one end thereof to said first frame member adjacent the forward end thereof and extending upwardly and rearwardly therefrom, the other end of said first hydraulic cylinder being pivotally secured to said first boom arm forwardly of the rearward end thereof, a second hydraulic cylinder pivotally secured at one end thereof to said second frame member adjacent the forward end thereof and extending upwardly and rearwardly therefrom, the other end of said second hydraulic cylinder being pivotally secured to said second boom arm forwardly of the rearward end thereof, a materials handling attachment on the forward end of said boom arms, the rearward end of said third frame member being adapted for selective connection to said rear connector element on said first support frame, the rearward end of said fourth frame member being adapted for selective connection to said rear connector element on said second support frame, first connection means at one side of said front frame portion for selective connection to said front connector element on said first support frame, second connection means at the other side of said front frame portion for selective connection to said front connector element on said second support frame, each of said rear connector elements comprising a generally rectangular shaped pocket adapted to receive and embrace the rearward end of the associated frame member, each of said pockets comprising spaced-apart top and bottom walls extending outwardly from said frame member, and an outer wall extending between said top and bottom walls, the rearward end of said bottom wall terminating forwardly of the rearward end of said top wall, the forward end of said top wall terminating rearwardly of the forward end of said bottom wall, each of said third and fourth frame members having a downwardly extending finger mounted thereon for selective engagement with the rearward end of said bottom wall on said pocket.

* * * * *